United States Patent [19]

Tomita

[11] Patent Number: 4,571,070

[45] Date of Patent: Feb. 18, 1986

[54] CLEANING DEVICE FOR PHOTOCONDUCTIVE ELEMENT OF ELECTROPHOTOGRAPHIC COPIER OR THE LIKE

[75] Inventor: Satoru Tomita, Kawasaki, Japan

[73] Assignee: Ricoh Company, Ltd., Tokyo, Japan

[21] Appl. No.: 593,216

[22] Filed: Mar. 27, 1984

[30] Foreign Application Priority Data

Mar. 31, 1983 [JP] Japan ..... 58-53991
Apr. 26, 1983 [JP] Japan ..... 58-61577[U]

[51] Int. Cl.[4] ..... G03G 21/00

[52] U.S. Cl. ..... 355/15; 118/652; 15/256.52

[58] Field of Search ..... 355/15, 3 R; 118/652; 430/125; 15/256.51, 256.52

[56] References Cited

U.S. PATENT DOCUMENTS 4,499,849 2/1985 Tomita et al. ..... 355/15 X
4,501,484 2/1985 Shimura ..... 355/15

*Primary Examiner*—R. L. Moses
*Attorney, Agent, or Firm*—David G. Alexander

[57] ABSTRACT

A cleaning device includes a rotatable cleaning sleeve and magnets housed in the cleaning sleeve in order to remove residual toner particles from a photoconductive element of an electrophotographic copier or the like, which is supported by a frame in the form of a belt or a sheet. A pressing mechanism is employed to maintain the surface of the photoconductive element in pressing contact with the cleaning sleeve. The pressing mechanism comprises a pressing member which includes a soft member and is magnetically attracted by the magnets in the sleeve to cause the photoconductive element into pressing contact with the cleaning sleeve, and an urging member consisting of a magnetic member or a magnet and also magnetically attracted for urging the frame toward the cleaning sleeve. Pressure force magnifying members are provided for magnifying the pressure force in laterally opposite end portions of the photoconductive element.

14 Claims, 25 Drawing Figures

CLEANING DEVICE FOR PHOTOCONDUCTIVE ELEMENT OF ELECTROPHOTOGRAPHIC COPIER OR THE LIKE

BACKGROUND OF THE INVENTION

The present invention relates to a cleaning device for removing a developer remaining on a recording element which is installed in a recording apparatus and, more particularly, to a cleaning device for removing residual toner and like developer particles from a photoconductive element of an electrophotographic copier or the like which may be formed as a sheet or a belt.

In an electrophotographic copier, for example, a latent image electrostatically formed on a photoconductive drum or belt is developed by a developing unit and then transferred to a paper sheet by a transfer unit. Usually, a cleaning device is installed in such a copier in order to remove toner and other developer particles which remain on the surface of the drum or the belt after the transfer of the developed image. The cleaning device comprises, for example, a cleaning sleeve which has a length substantially equal to the width of the photoconductive element and is located to face the photoconductive element. A cleaning brush is formed on the surface of the cleaning sleeve using a suitable material, so that it may contact the surface of the photoconductive element to remove the residual toner. A primary requisite for effective cleaning is, therefore, that the cleaning brush formed on the cleaning sleeve and the surface of the photoconductive element be constantly held in even contact. Some implementations have heretofore been proposed to satisfy the requisite and have proved to be useful individually.

However, a problem has been encountered with such a cleaning device in that after a long time of use of the copier the pressing contact of the cleaning sleeve with the surface of the photoconductive element becomes uneven in the widthwise direction of the photoconductive element, tending to bring about irregularity in the cleaning operation. The even cleaning effect is unattainable especially when the width of a developing sleeve in the developing unit is varied due to aging until the distribution range or the deposition condition of the residual toner on the photoconductive element has changed. Meanwhile, in an intermediate portion of the cleaning sleeve which remains in contact with the residual toner on the photoconductive element while attracting it thereonto, the toner is usually scraped off by a blade or the like and then discharged to the outside. However, the toner progressively accumulates on the cleaning sleeve as the time lapses with the result that the diameter of the cleaning sleeve intermediate portion gradually changes and, eventually, becomes larger than the diameter of opposite end portions of the sleeve which hardly touch the residual toner on the photocondutive element during cleaning. This causes the cleaning sleeve to contact the surface of the photoconductive element with different pressures at the intermediate portion and the opposite end portions, rendering a desirable cleaning effect unachievable.

SUMMARY OF THE INVENTION

It is therefore an object of the present invention to provide a cleaning device for a photoconductive element of an electrophotographic copier which constantly offers an excellent cleaning effect.

It is another object of the present invention to provide a cleaning device for a photoconductive element of an electrophotographic copier which is free from deterioration of the cleaning function due to aging.

It is another object of the present invention to provide a cleaning device for a photoconductive element of an electrophotographic copier which attains an excellent cleaning effect by a simple construction.

It is another object of the present invention to provide a generally improved cleaning device for a photoconductive element of an electrophotographic copier.

A cleaning device for removing a developer remaining on a surface of recording element of the present invention comprises cleaning means for removing the residual developer in contact with the surface of the recording element, pressing contact means for causing the recording element to pressingly contact the cleaning means, and urging means for urging the frame toward the cleaning means.

In accordance with the present invention, a cleaning device includes a rotatable cleaning sleeve and magnets housed in the cleaning sleeve in order to remove residual toner particles from a photoconductive element of an electrophotographic copier or the like, which is supported by a frame in the form of a belt or a sheet. A pressing mechanism is employed to maintain the surface of the photoconductive element in pressing contact with the cleaning sleeve. The pressing mechanism comprises a pressing member which includes a soft member and is magnetically attracted by the magnets in the sleeve to cause the photoconductive element into pressing contact with the cleaning sleeve, and an urging member consisting of a magnetic member or a magnet and also magnetically attracted for urging the frame toward the cleaning sleeve. Pressure force magnifying members are provided for magnifying the pressure force in transversely opposite end portions of the photoconductive element.

The above and other objects, features and advantages of the present invention will become apparent from the following detailed description taken with the accompanying drawing.

BRIEF DESCRIPTION OF THE DRAWING

FIGS. 3A and 3B are views of a prior art cleaning device which is installed in an electrophotographic copier or the like;

DESCRIPTION OF THE PREFERRED EMBODIMENTS

While the cleaning device for a photoconductive element of an electrophotographic copier or the like of the present invention is susceptible of numerous physical embodiments, depending upon the environment and requirements of use, substantial numbers of the herein shown and described embodiments have been made, tested and used, and all have performed in an eminently satisfactory manner.

Before entering into details of the present invention, prior art cleaning devices of the kind described and electrophotographic copiers using them will be described.

Figure 1:
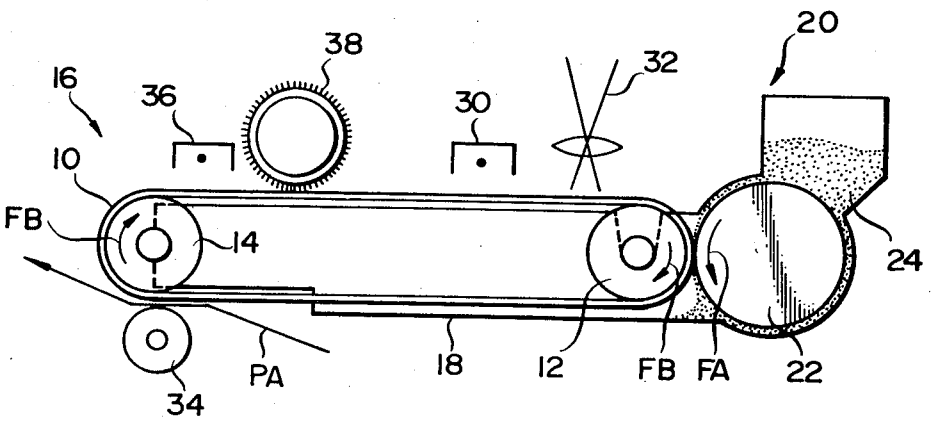
FIG. 1 is a schematic front view of an exemplary electrophotographic copier of the type using a photoconductive element in the form of a sheet or a belt.

Referring to FIG. 1 of the drawing, there is shown an electrophotographic copier using a photoconductive element in the form of a belt which represents recording apparatuses of the type using a sheet-shaped or belt-shaped recording element. As shown, an endless belt 10 serving as a photoconductive element is passed over a drive roller 12 and a driven roller 14 and forms a photoconductive element unit 16 in cooperation therewith. The unit 16 is detachably mounted on a platform 18. A developing unit 20 is positioned to the right of the platform 18 so as to develop a latent image which is formed on the belt 10. In the developing unit 20, a developing sleeve 22 is disposed to rotate as indicated by an arrow FA so that a developer (referred to simply as "toner" hereinafter) is deposited on the belt 10 which is moving in a direction indicated by an arrow FB.

The platform 18 is set in the copier body with the units 16 and 20 mounted thereon. Various units are shown in FIG. 1 in a condition wherein the platform 18 is set in the copier body as mentioned. Disposed around the belt 10 are a charger 30, an imaging unit 32, a transfer unit 34, a discharger 36 and a cleaning unit 38 in this order. Rotating in the direction FB, the belt 10 is charged by the charger 30 and then exposed to image light by the imaging unit 32 to be formed with an electrostatic latent image thereon. The latent image is developed by the developing unit 20 whereafter the resulting toner image is transferred to a paper sheet PA by the transfer unit 34.

After the transfer of the toner image, the belt 10 is discharged by the discharger 36 and, then, its surface is cleaned by the cleaning unit 36.

Figure 2A:
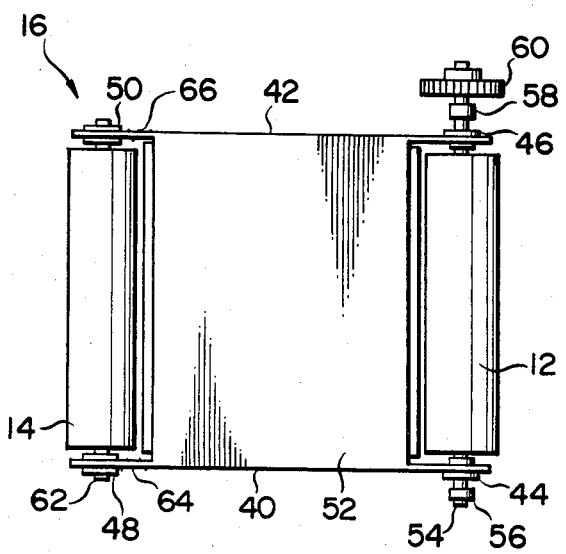
FIGS. 2A–2C are views of an example of a photoconductive element unit.
Figure 2C:
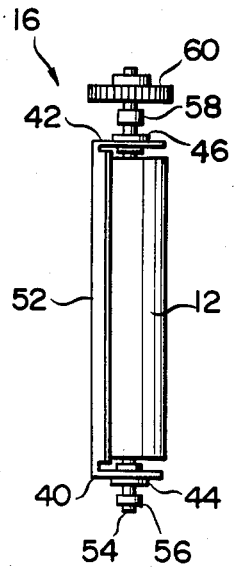
Figure 2B:
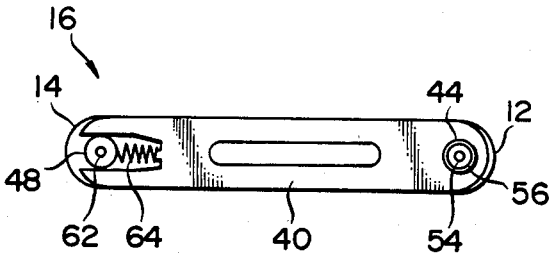

Referring to FIGS. 2A–2C, an example of the photoconductive element unit 16 is shown with the belt 10 removed for clarity. The drive roller 12 and driven roller 14 are individually journalled to side plates 40 and 42 by bearings 44, 46, 48 and 50. The side plates 40 nd 42 are commonly supported by a top plate 52. A shaft 54 of the drive roller 12 carries therewith bearings 56 and 58 and a drive gear 60. The bearings 56 and 58 are adapted to support the unit 16 on the platform 18. The drive gear 60 is connected to drive means, not shown. Springs 64 and 66 act between the driven roller 14 and the side plates 40 and 42 to impart tension to the belt 10

Usually, a cleaning sleeve whose length is, for example, substantially the same as the width of a photoconductive element is installed in a cleaning device, with a cleaning brush formed thereon using a suitable material. The cleaning brush is held in contact with the surface of the photoconductive element to clean its surface. What is necessary for good cleaning is that the brush on the sleeve surface be kept in even contact with the surface of the photoconductive element and, therefore, that the gap between the sleeve and the photoconductive element be always maintained constant.

In light of this, improve cleaning devices have been proposed for a photocondutive element, as shown in FIGS. 3–7.

Figure 3A:
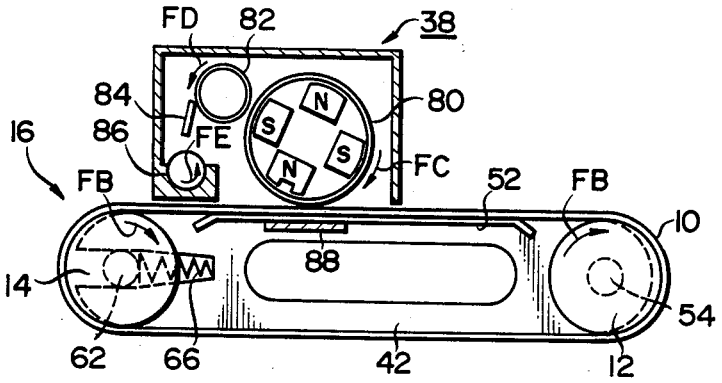
FIG. 3A PRIOR ART
Figure 3B:
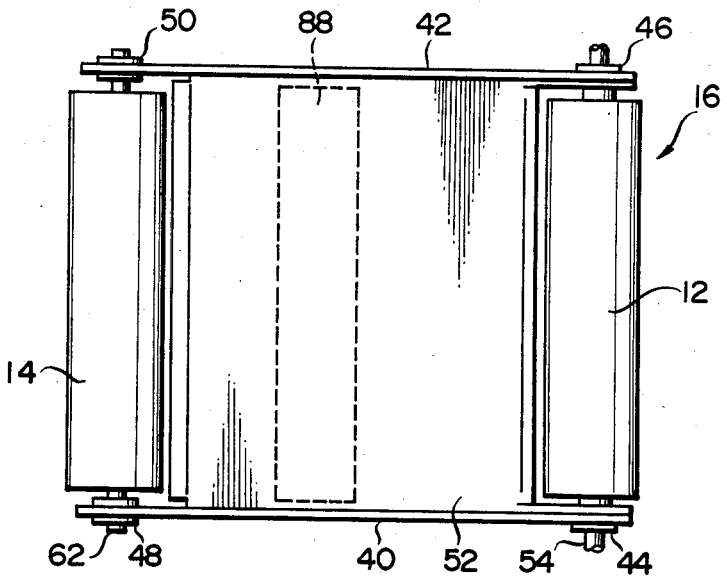
FIG. 3B PRIOR ART

Referring to FIGS. 3A and 3B, the improved cleaning device, generally 38, includes S- and N-pole magnets which alternate with each other inside a sleeve 80 and sequentially face the photoconductive element, or belt, 10. The toner deposited on the sleeve 80 is transferred to a collector roller 82, then scraped off by a blade 84, and then forced by a screw 86 out of the cleaning device.

A magnetic plate 88 is mounted on the top plate 52 over the width of the belt 10 in such a manner as to face the sleeve 80 from below (see FIG. 3B). In the unit 16, some play is structurally unavoidable between the shafts 54 and 62 of the drive roller 12 and driven roller 14 and the bearings 44, 46, 48 and 50 or between the bearings 44, 46, 48 and 50 and the side plates 40 and 42. The play allows the magnetic plate 88 to move relatively. Therefore, the magnetic plate 88 is moved upwardly attracted by the magnets in the sleeve 80. This maintains the gap between the surface of the sleeve 80 and that of the belt 10 even, thereby effecting good cleaning. That is, the belt 10 moving in the direction FB is evenly pressed against the sleeve 80 by the attraction of the magnetic plate 88, so that the residual toner is passed to the sleeve 80, which is rotating as indicated by the arrow FC, and then discharged to the outside via the collector roller 82, which is rotating in a direction FD, and the screw 86 which is rotating in a direction FE.

Figure 4:
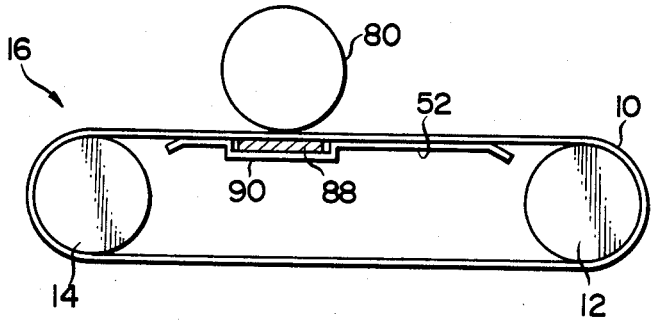
FIG. 4 PRIOR ART
FIG. 4 is a schematic front view of another example of prior art cleaning devices.

Another example of the improved cleaning devices is shown in FIG. 4. In this example, the magnetic plate 88 is nested in a recess 90 which is formed in the top plate 52. In this construction, the magnetic plate 88 locally presses only the belt 10 against the sleeve 80.

Figure 5:
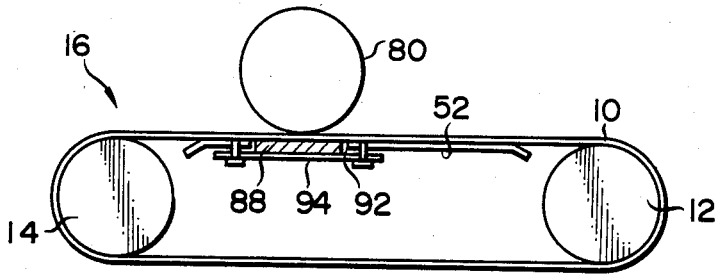
FIG. 5 PRIOR ART
FIG. 5 is a schematic front view of still another example of prior art cleaning devices.

Another example of the improved cleaning devices is shown in FIG. 5. As shown, the top plate 52 is formed with an opening 92 while a support plate 94 is provided in correspondence with the opening 92. The magnetic plate 88 is received in the space defined by the opening 92 and the support plate 94.

Figure 6:
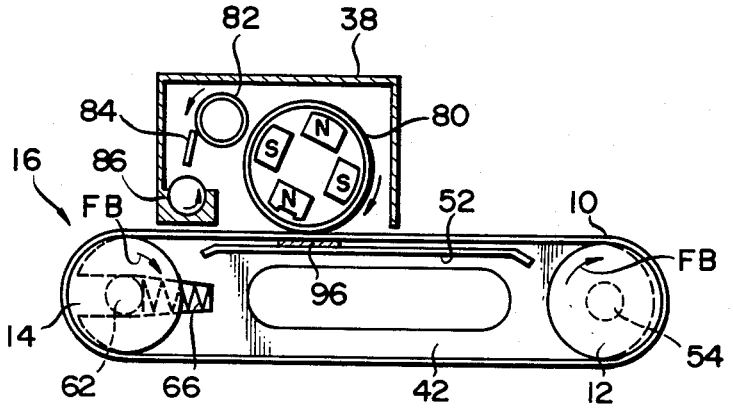
FIG. 6 PRIOR ART
FIG. 6 is a front view of a farther example of prior art cleaning devices.

Still another example of the improved cleaning devices is shown in FIG. 6. In this example, a soft member 96 is positioned on the surface of the top plate 52 in alignment with the sleeve 80. The belt 10 is evenly and partly pressed against the sleeve 80 due to elastic deformation of the soft member 96.

Figure 7:
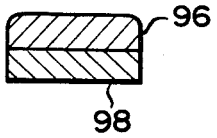
FIG. 7 PRIOR ART
FIG. 7 is a section showing a modification to a facing member of a prior art cleaning device.
Figure 8:
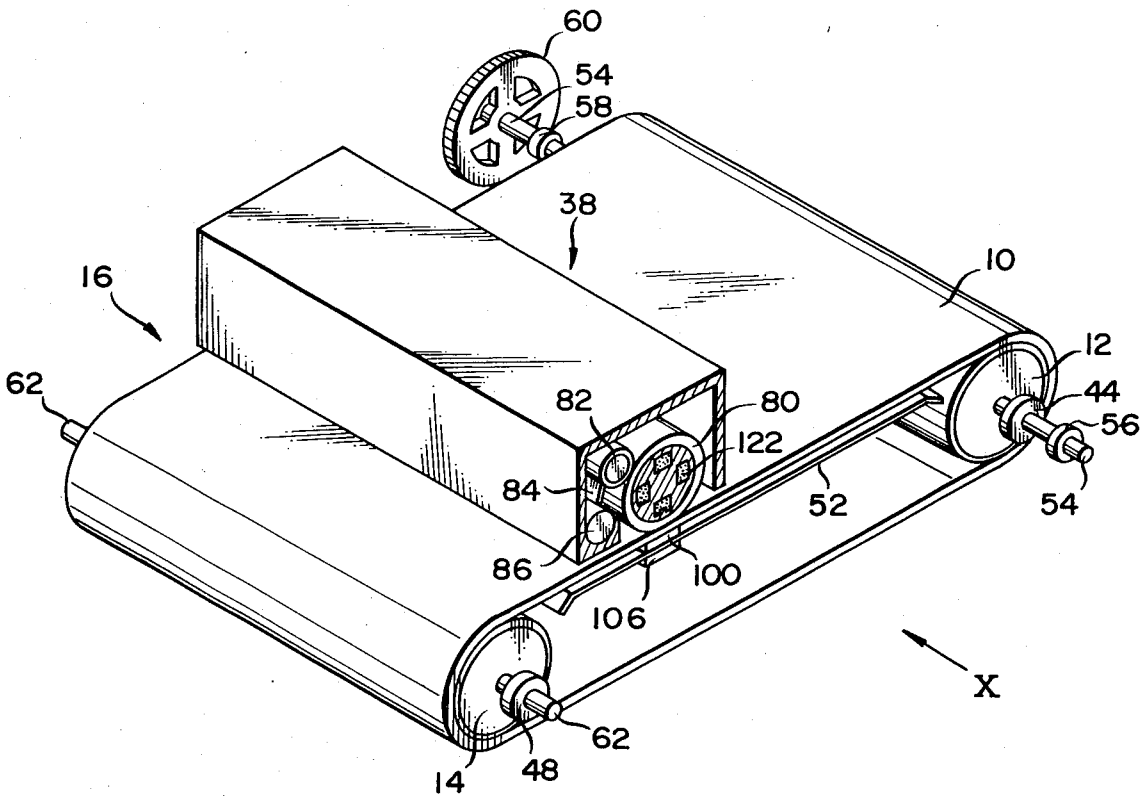
FIG. 8 is a perspective view of a cleaning device for a photoconductive element of an electrophotographic copier embodying the present invention.

A farther example of the improved cleaning devices is shown in FIG. 7. This example is a modification to the example of FIG. 6 and comprises a magnetic plate 98 mounted on the back of the soft member 96. Such a construction additionally utilizes the attraction which will act on the magnetic plate 98.

Details of the prior art cleaning devices described above are disclosed in Japanese patent application No. 51578/1981.

The effect attainable with any of the improved cleaning devices discussed above is substantial. However, where the frame of the photoconductive element unit 16, particularly the top plate 52, is locally deformed or where the play is uneven, for example, the pressing contact of the sleeve 80 with the belt 10 may become uneven in the widthwise direction of the belt 10 or the facing positions of the belt 88 and sleeve 80 may be changed relative to each other, resulting in irregular or incomplete cleaning.

The present invention is concerned with a cleaning device for a photoconductive element which is free from the above-described problem inherent in the prior art devices. Some preferred embodiments of the present invention will be described in detail with reference to FIGS. 8–21. Referring to FIGS. 8–11, a first embodiment of the cleaning device in accordance with the present invention is shown in combination with the photoconductive element unit 16. In these drawing, structural elements common or similar to those of FIGS. 1–7 are designated by like reference numerals and description thereof will be omitted for simplicity.

Figure 9:
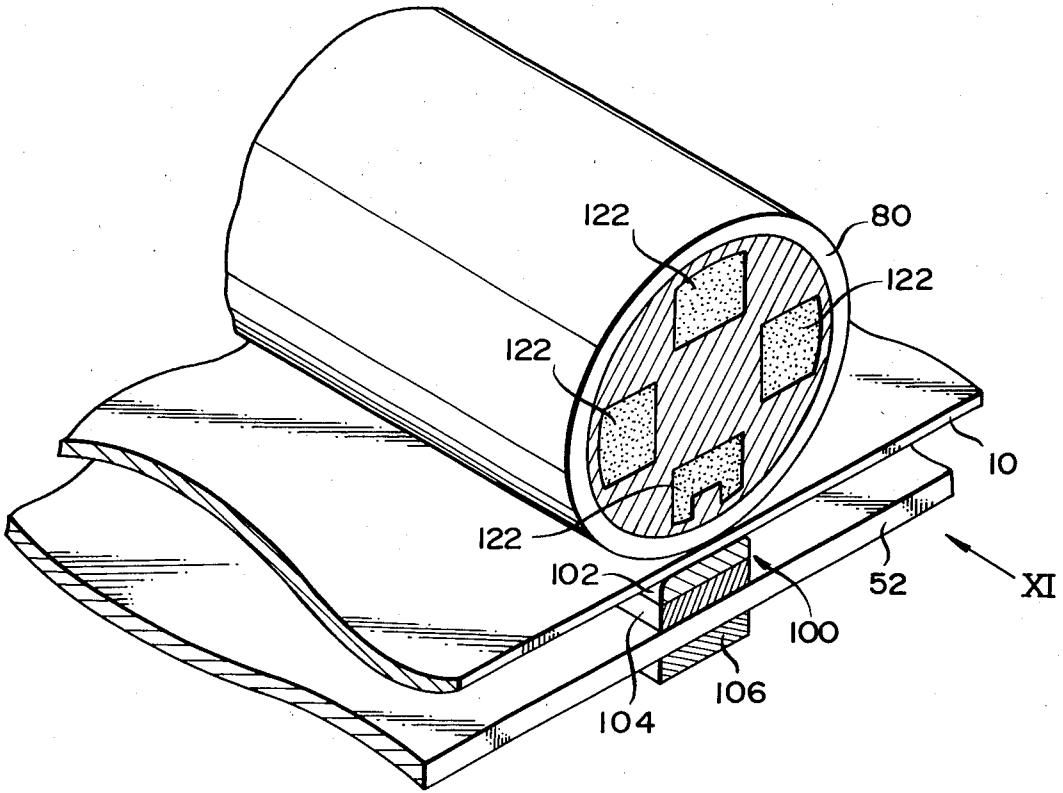
FIG. 9 is a fragmentary enlarged perspective view of the cleaning device shown in FIG. 8.
Figure 10:
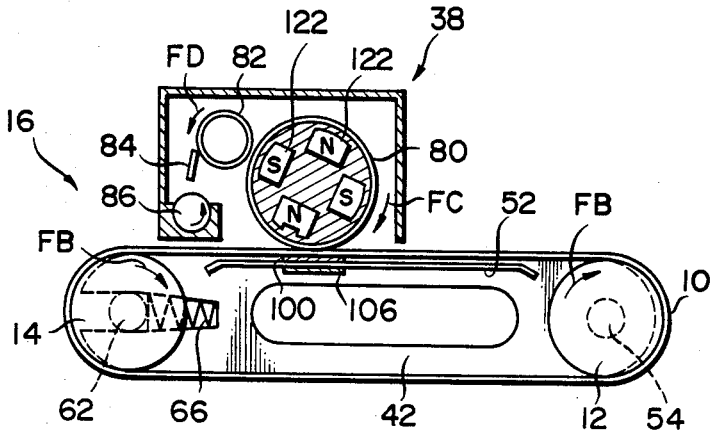
FIG. 10 is a front view as seen in a direction indicated by an arrow X in FIG. 8.
Figure 11:
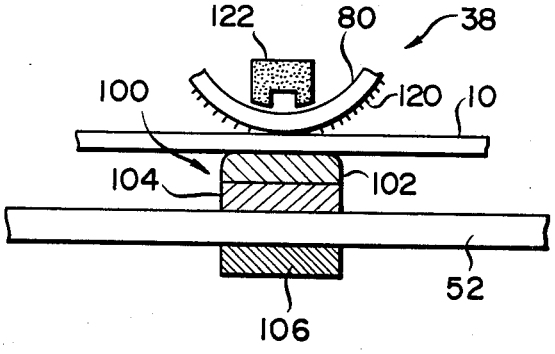
FIG. 11 is a front view as seen in a direction indicated by an arrow XI in FIG. 9.

In FIGS. 8–11, first pressing contact means, or first facing member, 100 is interposed between the photoconductive element, or endless belt, 10 and the top plate 52 and in a position where it faces the sleeve 80. Having a plate-like configuration, the facing member 100 extends along the width of the belt 10. As shown in FIG. 9 or 11, the facing member 100 is made up of an upper layer and a lower layer. One of the two layers which abuts against the belt 10 comprises a soft member 102 while the other which abuts against the top plate 52 comprises a magnetic plate 104.

Second pressing contact means, or second facing member, 106 is positioned at the back of the top plate 52 and in a position where it opposes the facing member 100. The facing member 106, like the facing member 100 extends in the widthwise direction of the belt 10. The facing members 100 and 106 sandwitch the top plate 52 therebetween, while the facing member 100 and the sleeve 80 sandwitch the belt 10 therebetween. The second facing member 106 may comprise a plate made of a magnetic material.

The first and second facing members 100 and 106 are attached to the top plate 52 by means of adhesive, for example. Also, the soft member 102 may be attached to the magnetic plate 104 by adhesive. The soft member 102 may be made of rubber, felt sponge or set bristles. Concerning set bristles, bristles of iron, stainless steel or like material may be directly set in the magnetic plate 104.

A brush 120 is formed on the surface of the sleeve 80 which is disposed in the cleaning device 38 (see FIG. 11). A plurality of magnets 122 are accommodated in the sleeve 80 such that the N- and S-poles alternate with each other.

In operation, the magnetic plate 104 of the first facing member 100 is magnetized by a magnetic field which is developed by the magnets 122. The polarity of the magnetization is dependent upon the polarity arrangement of the magnets 122. The second facing member 106 is magnetized in the same manner. As a result, the first and second facing members 102 and 106 are attracted toward the sleeve 80. That is, the belt 10 is urged by the first facing member 102 toward the sleeve 80, while the top plate 52 is urged toward the first facing member 100 by the second facing member 106.

In detail, the attraction acting on the first facing member causes the belt 10 to be locally deformed and this deformation occurs against the tension which is imparted to the belt 10 by the springs 64 and 66. The tension is not always evenly distributed over the entire belt 10, particularly in the longitudinal direction in FIG. 10 or 11, due to uneven symmetry of such structural members as the top plate 52 and side plates 40 and 42. This unevenness is reduced by the attraction acting on the second facing member 106 and the elastic deformation of the soft member 102. That is, as previously described, the top plate 52 has some play with respect to the belt 10 through the side plates 40 and 42 or the shafts 54 and 60 of the drive and driven rollers 12 and 14. The attraction acting on the facing member 106 enhances the symmetry of the top plate 52 within the range allowed by the play, thereby setting up an even pressure distribution which urges the belt 10 against the sleeve 80. The local deformtion of the top plate 52 and first and second facing members 100 and 106 is readily absorbed by the elastic deformation of the soft member 102 so that the pressure force acting on the belt 10 is made even.

In the embodiment described above, the pressure force acting on the belt 10 depends upon the elasticity of the soft member 102 and the configuration of the facing members 100 and 106, particularly their areas and thicknesses, and, therefore, such parameters are predetermind to set up a suitable pressure force. Advantageously, the soft member 102 is trimmed in thickness or made of a material having a high permeability so that magnetization of the magnetic plate 104 and, therefore, that of the facing member 106 may be promoted to increase the pressure force acting on the belt 10. Such will uniformalize the pressure force if the uneveness in symmetry is substantial, and thereby further improve the margin in the production stage while sufficiently withstanding aging. In the illustrative embodiment, the second facing member 106 may comprise a magnet so that, when the unit or cassette 16 is removed from the copier to become free from the influence of the magnetic field developed by the magnets 122 in the sleeve 80, the magnetic member 104 will be attracted by the facing member 106 to remain fixed in position.

Figure 12:
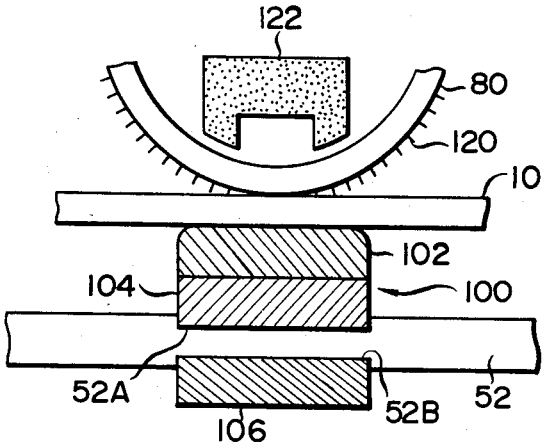
FIG. 12 is a front view of a second embodiment of the present invention.

Referring to FIG. 12, a second embodiment of the present invention is shown. In FIG. 12, the same or similar structural elements as those of the first embodiment are designated by like numerals and will not be described any further.

In the embodiment shown in FIG. 12, the second facing member 106 consists of a magnet. The top plate 52 is shaped to define recesses 52A and 52B in which the facing members 100 and 106 are received and positioned respectively. Because the magnetic plate 104 is attracted by the second facing member 106, no adhesive or like connecting means is required for the first and second facing members. The first facing member 100 remains in contact with the moving belt 10 and, therefore, it has to be replaced after a certain period of time of use. In the second embodiment, replacement of the member 100 is facilitated by the use of the magnetic connecting means for the member 100.

If desired, the simple recesses 52A and 52B may be replaced by suitable undulations which are engagable with undulations formed on the facing members 100 and 106. Such undulations are also applicable to the embodiment shown in FIG. 8.

The present invention is not limited to the first or second embodiment described above and any other structure may be employed insofar as it attains the function and operation described. For example, a mechanism for moving the cassette 16 bodily up and down may be added to the construction described above. A soft member may also be positioned in a location where the first facing member and/or the second facing member contacts the top plate. The magnetic attraction means employed to move the belt and the top plate may be substituted for by a spring or the like. In case where magnets are absent in the sleeve, a magnet will be installed in a suitable position in the cleaning device. If desired, part of the casing of the cleaning device may comprise a magnetic member or a magnet and the facing members, magnets or magnetic members.

As described above, in accordance with the first or second embodiment of the present invention, a photoconductive element is moved toward a cleaning sleeve by a first facing member which has a soft member on its face that contacts the photoconductive element, while a frame holding the photoconductive element is moved by a second facing member. This allows the photoconductive element to be held in even pressing contact with the cleaning sleeve, so that not only the cleaning operation becomes free from irregularity but also the design of a structure for achieving such effect is made easy and provided with a greater margin.

A third embodiment of the present invention will be described hereinafter which is furnished with means for effectively eliminating deterioration of the cleaning function due to aging. To facilitate understanding of the third embodiment, description will first be made of major causes of deterioration of the cleaning function which originates from aging. In short, the deterioration is brought about by the fact that the toner is not deposited on end portions of a photoconductive element. In detail, the toner is deposited on the surface of a photoconductive element over a width which is substantially common to a developing width. While the toner is removed by a cleaning sleeve, the removed toner still sticks to the cleaning sleeve except for its opposite end portions thereby, in effect, increasing the diameter. This promotes good contact between the photoconductive element and the cleaning sleeve. However, the other portions of the cleaning sleeve, i.e. opposite end potions, are not held in such good contact, resulting in deterioration of the cleaning effect.

Figure 13A:
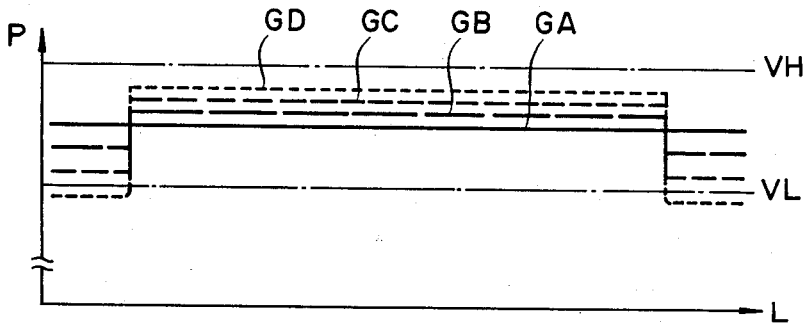
FIGS. 13A and 13B are diagrams representing a variation in the contact pressure acting between a cleaning sleeve and a photoconductive element.
Figure 13B:
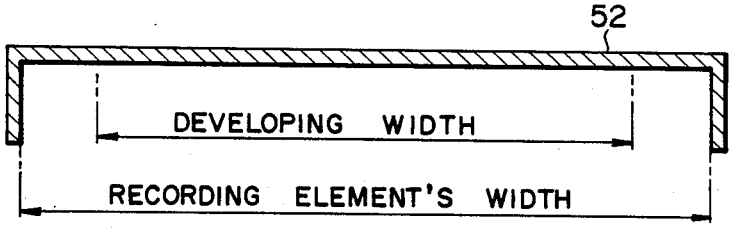

FIGS. 13A and 13B show a relationship of a position L of the top plate 52 to a pressure force P acting between the interengaged cleaning sleeve 80 and the belt 10, particularly the difference between the pressure force exerted by an intermediate portion of the cleaning sleeve 80 on the developing region of the belt 10 and the pressure force exerted by opposite end potions of the sleeve 80 on the non-developing regions. The upper limit VH and the lower limit VL define a range of the pressure force P which effects good cleaning. At the beginning of use, the pressure force P is even both in the end and intermediate portions of the sleeve 80 as indicated by GA. However, with the lapse of time, the pressure force P sequentially varies as represented by GB, GC and GD; the pressure force P increases in the intermediate portion of the sleeve 80 but decreases in the opposite end portions until it becomes even lower than the lower limit VL, preventing the cleaning device to function as expected.

In the above condition, the toner is left unremoved in the opposite end portions of the surface of the belt 10. Furthermore, as the formation of the developing brush becomes insufficient, it is impossible to attain the scavenging effect. As a result, even the residual toner is transferred onto the paper sheet PA by the transfer unit 34. In practice, the result is vertical stripes appearing on the paper sheet PA or the like, which degrades the reproduced picture.

Hereinafter will be described a third embodiment of the present invention which insures desirable quality of reproduction by eliminating such deterioration of the cleaning effect due to aging.

Figure 14:
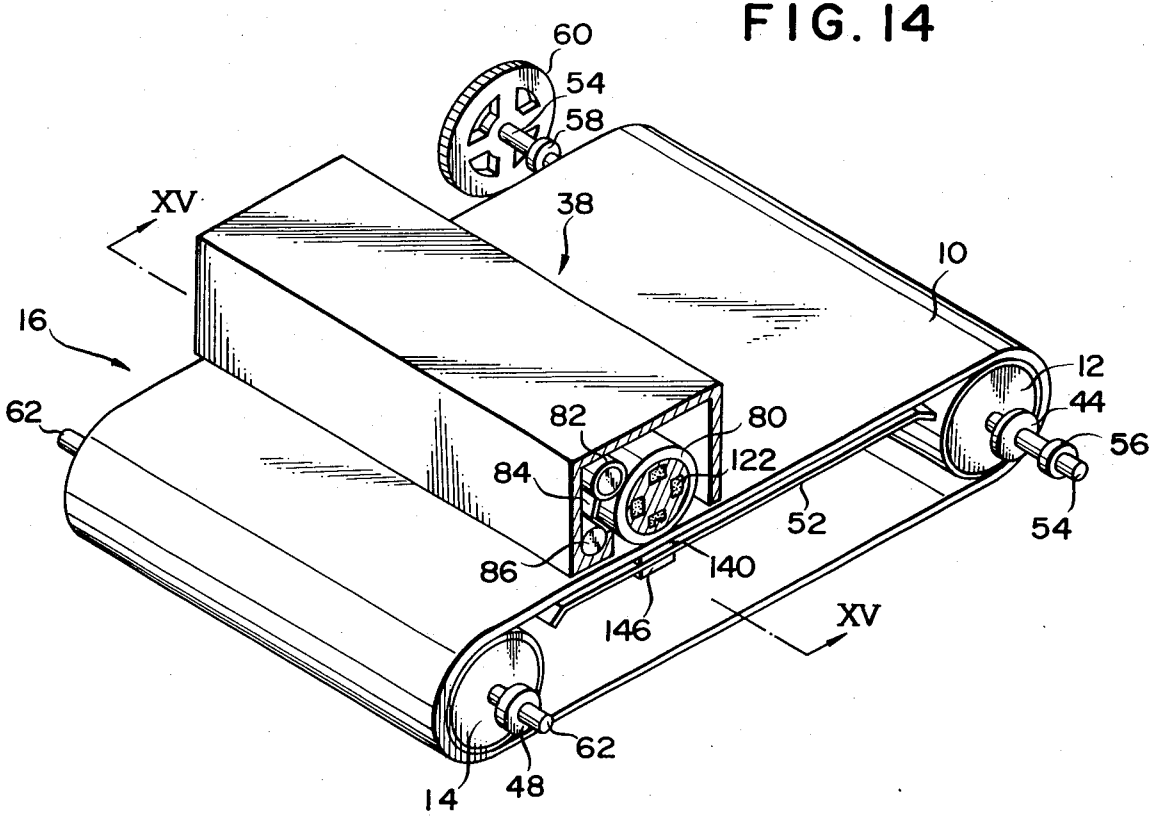
FIG. 14 is a perspective view of a third embodiment of the present invention.
Figure 15:
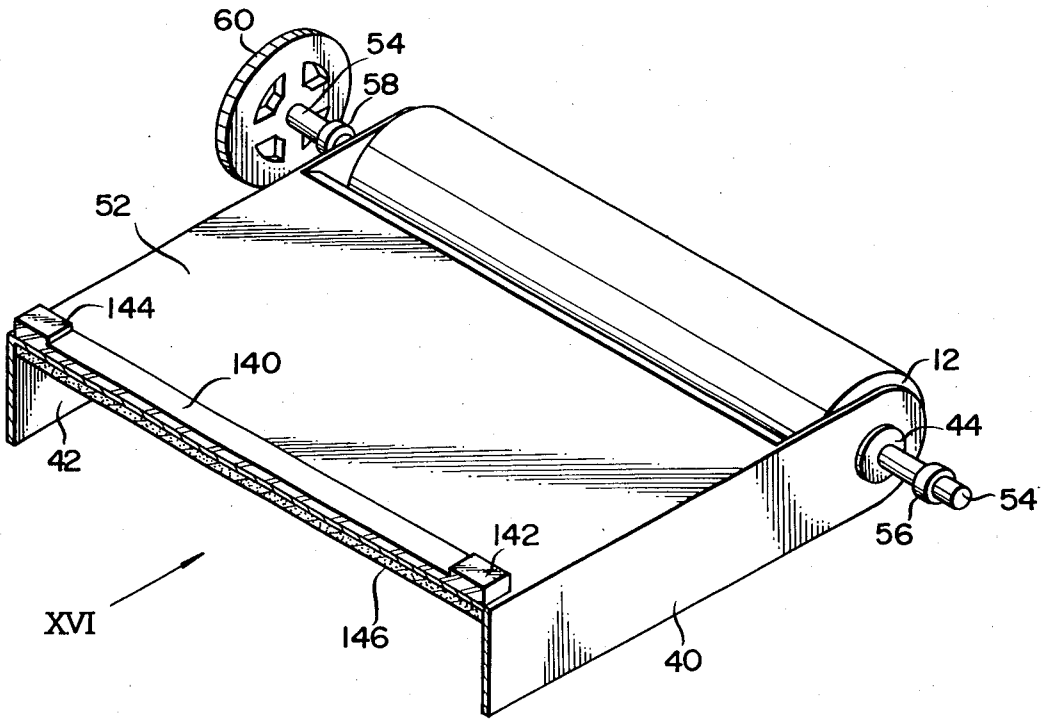
FIG. 15 is a fragmentary perspective view taken along line XV—XV of FIG. 14.
Figure 16:
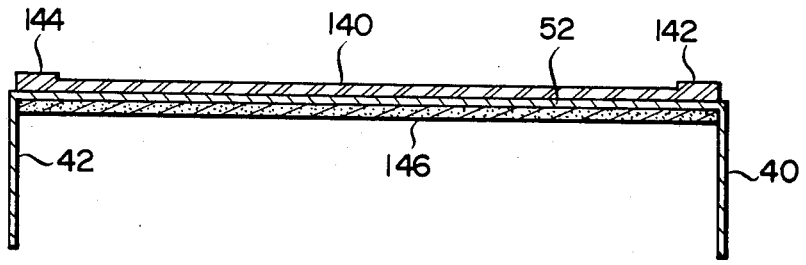
FIG. 16 is an end view as seen in a direction indicated by an arrow XVI in FIG. 15.

Referring to FIGS. 14–16, the cleaning device in accordance with the third embodiment is shown which is built in the photoconductive element unit 16. As shown, a facing member 140 consisting of a soft member is interposed between the belt 10 and the top plate 52 and in a position where it opposes the sleeve 80. The facing member 140, like those in the foregoing embodiments, is formed flat and laid along the width of the belt 10. Characteristically, however, the facing member 140 has a thickness which is increased at longitudinally opposite end portions thereof, as shown in FIG. 15 or 16. A facing member 146 similar to those of the foregoing embodiments is mounted on the back of the top plate 52 to oppose the facing member 140.

Figure 17:
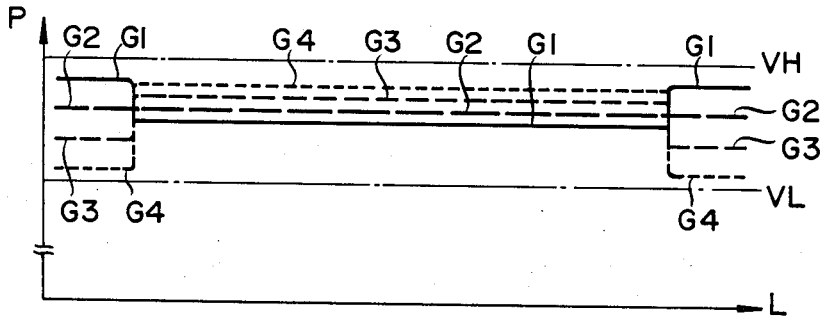
FIG. 17 is a diagram showing a variation in the contact pressure attainable with the embodiment shown in FIGS. 14–16.

FIG. 17 is a view similar to FIG. 13A but showing a variation of the pressure force attainable with the third embodiment shown in FIGS. 14–16. Just after the start of use of the cleaning device 38, the pressure force P acting between the belt 10 and the sleeve 80 is greater in opposite end portions than in the intermediate portion as indicated by G1, due to the influence of end portion 142 and 144 of the facing member 140. It will be seen by comparing G1 and GA of FIG. 13A that the pressure force P at the end portions is higher than one at the intermediate portion. Therefore, as indicated by G2, the pressure force P becomes even in both the intermediate and end portions upon the lapse of a predetermined period of time.

As the time further lapses, the pressure force P becomes lower in the opposite end portions than in the intermediate portion as indicated by G3 and G4. Nevertheless, as seen from GC and GD of FIG. 13A, the pressure force P in the end portions does not decrease beyond the lower limit VL so that the good cleaning effect is preserved. Stated another way, the end portions 142 and 144 of the facing member 140 increases the pressure force P in the end portions to delay the time at which any defect will occur in the cleaning operation, compared to the prior art cleaning devices. Therefore, quality reproduction is insured over a long time without resorting to maintenance, inspection or the like.

An experiment conducted with the construction shown in FIGS. 14–16 showed that a desirable characteristic is attainable when the difference in thickness between the intermediate portion and the end potions 143 and 144 of the facing member 140 lies in the range of 0.1–0.3 millimeters.

Figure 18:
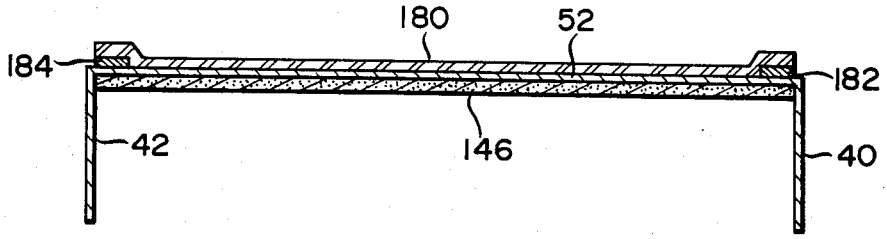
FIG. 18 is an end view of a fourth embodiment of the present invention.

Referring to FIG. 18, a fourth embodiment of the present invention is shown. In FIG. 18, the same or similar structural elements as those of the foregoing embodiments are designated by like reference numerals and description thereof will be omitted for simplicity.

FIG. 18 is a view corresponding to FIG. 16. In FIG. 18, a facing member 180 is mounted on the top plate 52 in the same manner as the facing member 140. The facing member 180 is even in thickness throughout its length. Spacers 182 and 184 are respectively interposed between the top plate 52 and opposite end portions of the facing member 180 whereby opposite end portions of the facing member 180 are individually raised to increase the pressure force P thereat. If use is made of a magnetic material for the spacers 182 and 184, the effect discussed in conjunction with the magnetic plate 88 will be achieved, especially in the opposite end portions.

Figure 19:
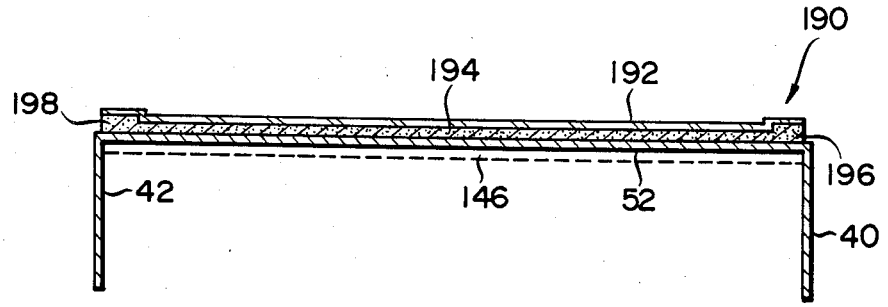
FIG. 19 is an end view of a fifth embodiment of the present invention.

A fifth embodiment of the present invention will be described with reference to FIG. 19, which corresponds to FIG. 16 or 18. In FIG. 19, a facing member 190 is made up of a soft member 192 and a flat magnetic member or magnet 194. The thickness of the magnetic plate 194 is larger in opposite end portions 196 and 198 than in an intermediate portion. The soft member 192 has an even thickness and overlies the magnetic plate 194. Such an arrangement, like the foregoing ones, serves to increase the pressure force P at opposite end portions.

Sixth and seventh embodiments of the present invention will be described with reference to FIGS. 20 and 21.

Figure 20:
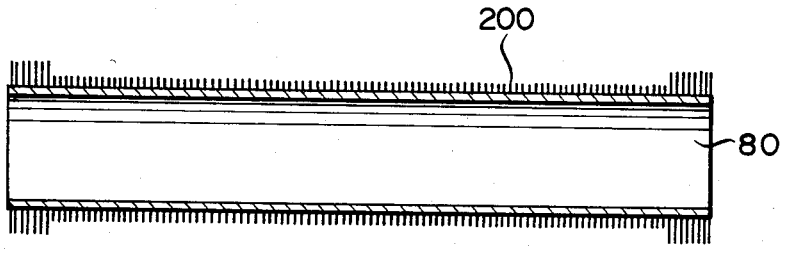
FIG. 20 is a section of a sixth embodiment of the present invention.
Figure 21:
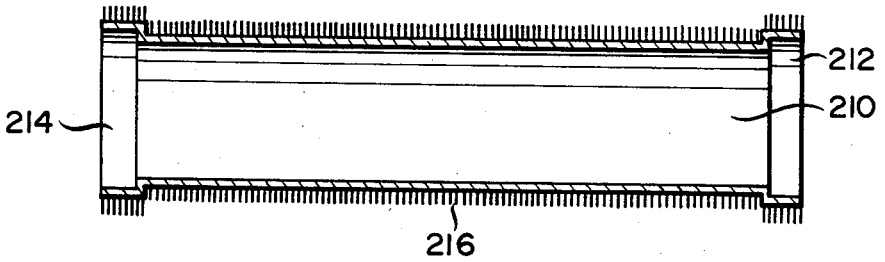
FIG. 21 is a section of a seventh embodiment of the present invention.

The embodiments shown in FIGS. 20 and 21 are commonly elaborated to increase the pressure force P in opposite end portions by improving the configuration of the cleaning brush portion, which is formed on the cleaning sleeve 80 of the cleaning device 38.

In FIG. 20, a cleaning brush 200 formed on the cleaning sleeve 80 is shaped longer in opposite end portions than in the intermediate portion.

In FIG. 21, the diameter of a cleaning sleeve 210 is increased in opposite end portions 212 and 214 relative to an intermediate portion, while a brush 216 is formed on the cleaning sleeve 210 to a common length.

Among the third to seventh embodiments, the embodiment shown in FIGS. 16, 18 or 19 may be combined with the embodiment shown in FIG. 20 or 21. The present invention is applicable not only to a magnetic toner but to a non-magnetic toner. If desired, the rigidity may be varied in the opposite end portions, instead of the thickness of the facing member or the length of the brush.

It will now be seen that in accordance with the third to seventh embodiments the pressure force acting on a cleaning sleeve is made greater in opposite end portions than in an intermediate portion of a photoconductive element by using a suitable facing member or improving a cleaning sleeve. This offers an even cleaning characteristic over a long time against residual toner on the photoconductive element, thereby insuring stable quality production over a long time.

Various modifications will become possible for those skilled in the art after receiving the teachings of the present disclosure without departing from the scope thereof.

What is claimed is:

1. A cleaning device for removing a developer remaining on a flat surface of a recording element comprising;

rotary cleaning means for removing the residual developer in contact with the surface of the recording element;

pressing contact means for causing the recording element to pressingly contact the cleaning means; and urging means for urging the pressing contact means toward the cleaning means;

the cleaning means comprising a cleaning sleeve having a length which is substantially equal to an effective width of the recording element, and magnets arranged in said cleaning sleeve;

the urging means comprising first magnetic attraction means for effecting magnetic attraction in cooperation with the magnets of the cleaning means;

the pressing contact means comprising a flat soft member having a length which is substantially equal to a width of the cleaning sleeve, the first magnetic attraction means comprising a first flat magnetic member having a length which is substantially common to the width of the cleaning sleeve;

the pressing contact means further comprising a second magnetic attraction means for effecting magnetic attraction in cooperation with the magnets of the cleaning means.

2. A cleaning device as claimed in claim 1 further comprising a frame for retaining the recording element, the second magnetic attraction means comprising a second flat magnetic member having a length substantially equal to the width of the cleaning sleeve and interposed between the soft member and a portion of the frame which faces said cleaning means.

3. A cleaning device as claimed in claim 2, in which the second flat magnetic member comprises at least one of a magnetic member and a magnet.

4. A cleaning device as claimed in claim 2, in which the pressing means further comprises a soft member having a length substantially equal to the width of the cleaning sleeve and arranged between the second flat magnetic member and said portion of the frame.

5. A cleaning device as claimed in claim 4, in which the urging means further comprises a soft member having a length substantially equal to the width of the cleaning sleeve and arranged between the first flat magentic member and said portion of the frame.

6. A cleaning device as claimed in claim 2, in which the frame comprises first positioning means formed on a rear surface of said portion of the frame which faces the cleaning means and engagable with the first flat magnetic member, and a second positioning means formed on a front surface of said portion of the frame which faces the cleaning means and engagable with the second flat magnetic member.

7. A cleaning device as claimed in claim 6, in which the first and second positioning means comprise recesses for receiving the first and second flat magnetic members respectively.

8. A cleaning device for removing a developer remaining on a flat surface of a recording element comprising:

rotary cleaning means for removing the residual developer in contact with the surface of the recording element;

pressing contact means for causing the recording element to pressingly contact the cleaning means;

urging means for urging the pressing contact means toward the cleaning means;

the cleaning means comprising a cleaning sleeve having a length which is substantially equal to an effective width of the recording element, and magnets arranged in said cleaning sleeve;

the urging means comprising first magnetic attraction means for effecting magnetic attraction in cooperation with the magnets of the cleaning means;

the pressing contact means comprising a flat soft member having a length which is substantially equal to a width of the cleaning sleeve, the first magnetic attraction means comprising a first flat magnetic member having a length which is substantially common to the width of the cleaning sleeve; and pressure force magnifying means for magnifying a pressure force acting between the cleaning means and the recording element in transversely opposite end portions of the recording element.

9. A cleaning device as claimed in claim 8, in which the pressure force magnifying means comprises a thickened portion formed at each of opposite end portions of the soft member of the pressing contact means, said thickened portion being thicker than an intermediate portion of the soft member.

10. A cleaning device as claimed in claim 8, in which the pressure force magnifying means comprises spacers for raising opposite end portions of the soft member of the pressing means.

11. A cleaning device as claimed in claim 10, in which each of the spacers comprises at least one of a magnetic member and a magnet.

12. A cleaning device as claimed in claim 8, further comprising a frame for retaining the recording element, the pressing contact means further comprising a second flat magnetic member interposed between the soft member and a portion of the frame which faces said cleaning means and effecting magnetic attraction in cooperation with the magnets of the cleaning means, the pressure force magnifying means comprising thickened portions of opposite end portions of said second flat magnetic member which are thicker than an intermediate portion of the second flat magnetic member.

13. A cleaning device as claimed in claim 8, in which the pressure force magnifying means comprises a cleaning brush which is longer in opposite end portions of the cleaning sleeve than in an intermediate portion.

14. A cleaning device as claimed in claim 8, in which the pressure force magnifying means comprises opposite end portions of the cleaning sleeve which are individually larger in diameter than an intermediate portion.

* * * * *